US010682019B2

(12) United States Patent
Streen et al.

(10) Patent No.: US 10,682,019 B2
(45) Date of Patent: Jun. 16, 2020

(54) COMPACT PORTABLE ABLUTION VESSEL

(71) Applicant: LOTA LITE LLC, Chandler, AZ (US)

(72) Inventors: David Streen, Chandler, AZ (US); Saba Mansoor, Glendale, AZ (US); Jamie Picus, Scottsdale, AZ (US); Marino Cecchi, Sun City West, AZ (US); James Losser, Streamwood, IL (US)

(73) Assignee: LOTA LITE LLC, Chandler, AZ (US)

( * ) Notice: Subject to any disclaimer, the term of this patent is extended or adjusted under 35 U.S.C. 154(b) by 0 days.

(21) Appl. No.: 16/029,503

(22) Filed: Jul. 6, 2018

(65) Prior Publication Data

US 2019/0008330 A1 Jan. 10, 2019

Related U.S. Application Data

(60) Provisional application No. 62/530,050, filed on Jul. 7, 2017.

(51) Int. Cl.

| | |
|---|---|
| ***A47K 3/18*** | (2006.01) |
| ***B65D 25/28*** | (2006.01) |
| ***B65D 75/00*** | (2006.01) |
| ***B65D 75/58*** | (2006.01) |
| ***B65D 33/02*** | (2006.01) |
| ***A45F 3/20*** | (2006.01) |
| ***B65D 5/44*** | (2006.01) |

(52) U.S. Cl.

CPC ..... *A47K 3/18* (2013.01); *A45F 3/20* (2013.01); *B65D 5/44* (2013.01); *B65D 25/2885* (2013.01); *B65D 33/02* (2013.01); *B65D 75/008* (2013.01); *B65D 75/5866* (2013.01); *B65D 75/5883* (2013.01)

(58) Field of Classification Search

CPC ..... B65D 5/44–46192; B65D 75/5866; B65D 75/5883; B65D 33/02; B65D 33/06; B65D 33/065; A45F 3/20; A45F 2003/205

See application file for complete search history.

(56) References Cited

U.S. PATENT DOCUMENTS

| | | | | | |
|---|---|---|---|---|---|
| 411,954 | A * | 10/1889 | Eggers | B65D 33/10 | 383/29 |
| 719,810 | A * | 2/1903 | Jones | A45F 3/02 | 224/601 |
| 929,209 | A * | 7/1909 | Grant | B65F 1/12 | 232/43.1 |
| 960,809 | A * | 6/1910 | Burch | A45C 13/004 | 383/127 |
| 1,041,758 | A * | 10/1912 | Ellis | B65D 88/1618 | 220/904 |

(Continued)

*Primary Examiner* — Patrick M. Buechner
*Assistant Examiner* — Randall A Gruby
(74) *Attorney, Agent, or Firm* — Eleanor Musick; Musick Davison LLP

(57) ABSTRACT

A vessel for containing water includes a bladder body formed from flexible substantially waterproof membrane sheets sealed at least partially around the sheet edges to define a bottom portion, a top opening, a handle portion and a spout. A support ring is sealed to the top opening to define a fill mouth for introducing water into the bladder body. The bladder body is configured to be folded into and retained within an interior of the support ring for storage.

20 Claims, 4 Drawing Sheets

(56) References Cited

U.S. PATENT DOCUMENTS 1,066,454 A * 7/1913 Allen ..... B65F 1/12 232/43.1
1,097,374 A * 5/1914 Summers ..... A01D 46/22 224/611
1,138,882 A * 5/1915 Meier ..... A45C 1/02 150/150
1,202,085 A * 10/1916 Mitchell ..... B65D 33/007 220/904
1,341,157 A * 5/1920 Sublett ..... 141/114
1,555,467 A * 9/1925 Graham ..... A01G 25/14 137/585
1,645,360 A * 10/1927 Taylor ..... A01D 46/22 224/611
1,798,094 A * 3/1931 Malvern ..... B65D 31/145 383/28
1,965,040 A * 7/1934 Kelly ..... F24B 15/007 209/370
1,994,362 A * 3/1935 Kavanagh ..... A01D 46/22 224/610
2,024,429 A * 12/1935 Casey ..... A61M 3/0266 383/7
2,072,225 A * 3/1937 Slater ..... A61F 7/08 383/41
2,179,280 A * 11/1939 Cary ..... B67B 7/28 222/475
2,383,230 A * 8/1945 Voke ..... B65D 35/12 156/69
D167,214 S * 7/1952 Name Not Available ..... D7/622
2,870,811 A * 1/1959 Harrison ..... A45C 1/00 383/109
2,873,905 A * 2/1959 Denton ..... B65D 33/14 383/22
3,307,549 A * 3/1967 Zackheim ..... A61M 3/0245 128/DIG. 24
3,381,874 A * 5/1968 Russo ..... B65D 33/1691 383/95
3,463,357 A * 8/1969 Maskell ..... B65D 75/5866 222/94
4,718,598 A * 1/1988 Pupp ..... B65D 5/727 222/210
4,804,134 A * 2/1989 Reil ..... B65D 5/46008 229/117.23
D319,586 S * 9/1991 Nylander ..... D7/319
D319,784 S * 9/1991 Nylander ..... D7/319
D320,161 S * 9/1991 Nylander ..... D7/317
D322,570 S * 12/1991 Nylander ..... D7/317
5,143,280 A * 9/1992 Reil ..... B29C 45/14598 229/117.23
5,478,152 A * 12/1995 Bogle ..... B65B 67/1222 220/9.4
6,361,210 B2 * 3/2002 Denko ..... A45C 1/02 150/150
7,055,720 B1 * 6/2006 Pritchard ..... B65D 33/2508 222/107
7,063,243 B2 * 6/2006 Forsman ..... A45F 3/20 215/306
D537,732 S * 3/2007 Rosen ..... D9/707
7,819,582 B2 * 10/2010 Rosen ..... B65D 75/008 383/207
8,007,174 B2 * 8/2011 Yamaguchi ..... A61J 1/10 383/104
8,186,392 B2 * 5/2012 Gustafsson ..... B65B 39/08 141/114
8,261,953 B2 * 9/2012 McSavaney ..... B65D 47/2018 215/271
8,992,084 B2 * 3/2015 Pellingra ..... B65D 33/065 383/12
10,189,609 B2 * 1/2019 Pellingra ..... B65D 33/065
2002/0076471 A1 * 6/2002 Olsson ..... B65D 75/008 426/86
2004/0035865 A1 * 2/2004 Rosen ..... B65D 33/02 220/4.01
2004/0248720 A1 * 12/2004 Rosen ..... B31B 70/00 493/356
2006/0140515 A1 * 6/2006 Inaba ..... B65D 75/008 383/104
2006/0210199 A1 * 9/2006 Ali ..... B65D 33/14 383/10
2008/0230549 A1 * 9/2008 Gustavsson ..... B65D 75/008 220/666
2008/0233252 A1 * 9/2008 Manning ..... A61J 9/005 426/412
2011/0162321 A1 * 7/2011 Gustafsson ..... B65B 39/10 53/266.1
2012/0076441 A1 * 3/2012 Kruse ..... B65D 75/008 383/12
2017/0088344 A1 * 3/2017 Herrick ..... B65D 47/122

* cited by examiner

COMPACT PORTABLE ABLUTION VESSEL

RELATED APPLICATIONS

This application claims the benefit of the priority of U.S. Provisional Application No. 62/530,050, filed Jul. 7, 2017, which is incorporated herein by reference in its entirety.

FIELD OF THE INVENTION

The present invention relates to a compact, collapsible vessel for retaining water for use in personal hygiene procedures.

BACKGROUND OF THE INVENTION

The personal cleansing ritual, or "wudu", is required in preparation for performing the five daily Muslim prayers (salah). This act of ablution is easily accomplished at home, but can present significant challenges when the person is away from home, for example, at work, out in public, or while travelling.

A "lota" is a traditional hand-held vessel designed to contain water to aid in cleansing rituals following bathroom "activities." Traditionally, the lota has resembled a tea pot with a large spout made of brass or copper. With increased westernization, the once-limited definition of what could be classified as a "lota" has expanded. Plastic watering jugs have become widely adopted, however, this approach is still impractical when outside of the home. In such cases, the common solution is to fill a cup, bottle, or other makeshift container with water at a sink before entering the bathroom stall. However, some may find this to be disrespectful, in addition to being somewhat clumsy, creating the risk of spilling water on the user's clothes or on the floor.

Accordingly, the need exists for a discrete, easily portable, optionally disposable vessel that can be used for personal hygiene when the user is away from home. The present invention is directed to such a need.

BRIEF SUMMARY

In an exemplary embodiment, a portable lota is formed by sealing layers of a flexible, water-tight membrane together along the edges for define a bladder body with a closed bottom, an inlet at the top for introducing water into the bladder, and a side spout connected to the bladder body through which water may be poured out. The bottom is preferably gusseted so that a flat surface is formed when the vessel is full. The top inlet is sealed around its edges to a more rigid support ring formed from plastic, e.g., polypropylene or Nylon, or cardboard or similar inexpensive material. The membrane may be plastic sheeting or a similar material that is flexible and substantially waterproof. It may have a thickness on the order 0.1 mm to 0.4 mm (~0.005 to 0.012 inch), and is preferably a food-grade material such as polyethylene (UMHW-PE, LD-PE, HD-PE), acetal co-polymer, acrylic, poly-lactic acid (PLA), vinyl, or other known plastics and polymers. In some embodiments, the sheeting may be biodegradable. The bladder body should be sufficiently foldable and pliable to allow the unfilled bladder to be folded flat into the interior of the support ring, allowing it to be easily and discretely carried in the user's pocket, purse, or backpack, or kept in a drawer for easy access. The entire assembly may be packaged in shrink wrap, a small plastic or foil bag, or a paper wrapping, or other suitable means, to keep it clean and protected until ready for use.

When filled and fully expanded, the vessel will be able to stand on its own until the water is used. In a particularly preferred embodiment, the assembly may be discarded after use.

In one aspect of the invention, a vessel for containing water includes a bladder body formed from flexible membrane sheets sealed at least partially around the sheet edges to define a bottom portion, a top opening, a handle portion and a spout, the bottom portion configured to retain water; and a support ring sealed to the top opening to define a fill mouth for introducing water into the bladder body; wherein the bladder body is configured to be folded into and retained within an interior of the support ring for storage. The handle portion of the vessel may include reinforcing handle tabs attached thereto. In some embodiments, stability struts may be included extending between a reinforced portion of the bladder body and the support ring. In some embodiments, the reinforced portion of the bladder body forms handle tabs attached to the handle portion, and the stability struts, handle tabs and support ring may be molded together as an integrated structure. The handle portion may further include a slip-resistant surface. In a preferred embodiment, the flexible membrane sheets comprise a food-grade plastic or polymer. The bottom portion of the vessel may comprise a gusset. The bladder body may have a shape that is substantially similar to a tea pot.

In another aspect of the invention, a vessel for containing water includes a semi-rigid ring and a bladder body having an upper opening sealed to the ring, the bladder body formed from flexible substantially waterproof membrane sheets sealed at least partially around the sheet edges to define a bottom portion, a handle portion and a spout, the bottom portion configured to retain water; wherein the bladder body is configured to be folded into and retained within an interior of the ring for storage. The handle portion of the vessel may include reinforcing handle tabs attached thereto. In some embodiments, stability struts may be included extending between a reinforced portion of the bladder body and the ring. In some embodiments, the reinforced portion of the bladder body forms handle tabs attached to the handle portion, and the stability struts, handle tabs and ring may be molded together as an integrated structure. The handle portion may further include a slip-resistant surface. In a preferred embodiment, the flexible membrane sheets comprise a food-grade plastic or polymer or otherwise waterproof substrate. The bottom portion of the vessel may comprise a gusset. The bladder body may have a shape that is substantially similar to a tea pot.

In still another aspect of the invention, a vessel to receive and dispense a liquid includes a bladder body formed from flexible substantially waterproof membrane sheets sealed at least partially around the sheet edges to define a bottom portion, a top opening, a handle portion, and a spout with a spout opening, the bottom portion configured to retain a liquid, wherein the bottom portion comprises an expandable gusset configured to define a flat bottom when the bladder body is filled with liquid; and a semi-rigid ring sealed to the top opening to define a fill mouth for introducing liquid into the bladder body. The bladder body is configured to be folded into and retained within an interior of the support ring for storage. When the bladder body is filled with liquid, tilting the bladder body causes liquid to be dispensed through the spout opening. The handle portion may further include reinforcing handle tabs that have a slip-resistant surface. In some embodiments, stability struts may be included extending between a reinforced portion of the bladder body and the ring. In some embodiments, the reinforced portion of the bladder body forms handle tabs attached to the handle portion, and the stability struts, handle tabs and ring may be molded together as an integrated structure.

DETAILED DESCRIPTION OF EXEMPLARY EMBODIMENTS

Figure 1:
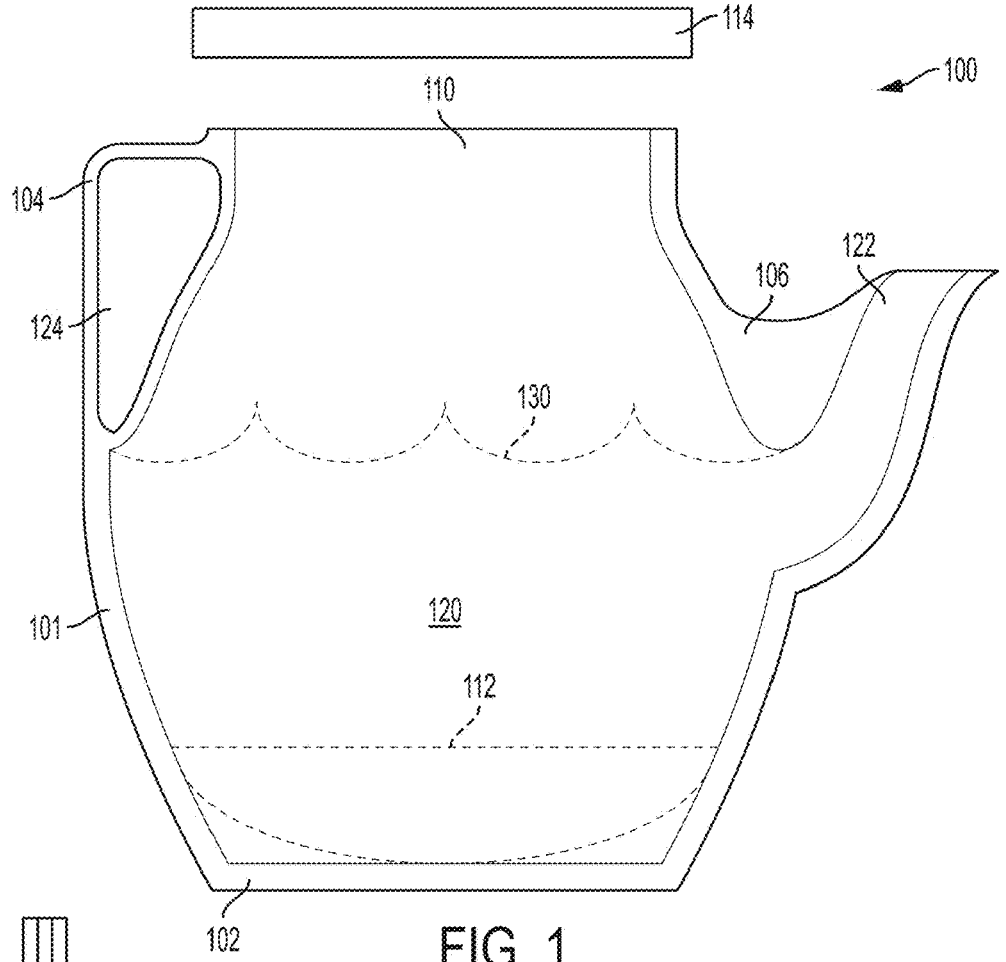
FIG. 1 is a diagrammatic side view, partially exploded, of a first embodiment of a portable lota according to the invention.
Figure 2:
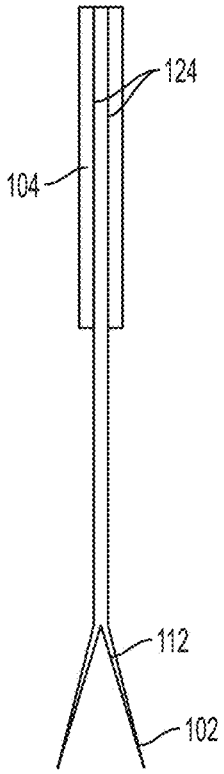
FIG. 2 is a rear view of an embodiment of an unexpanded portable lota showing the bottom gusset.
Figure 4:
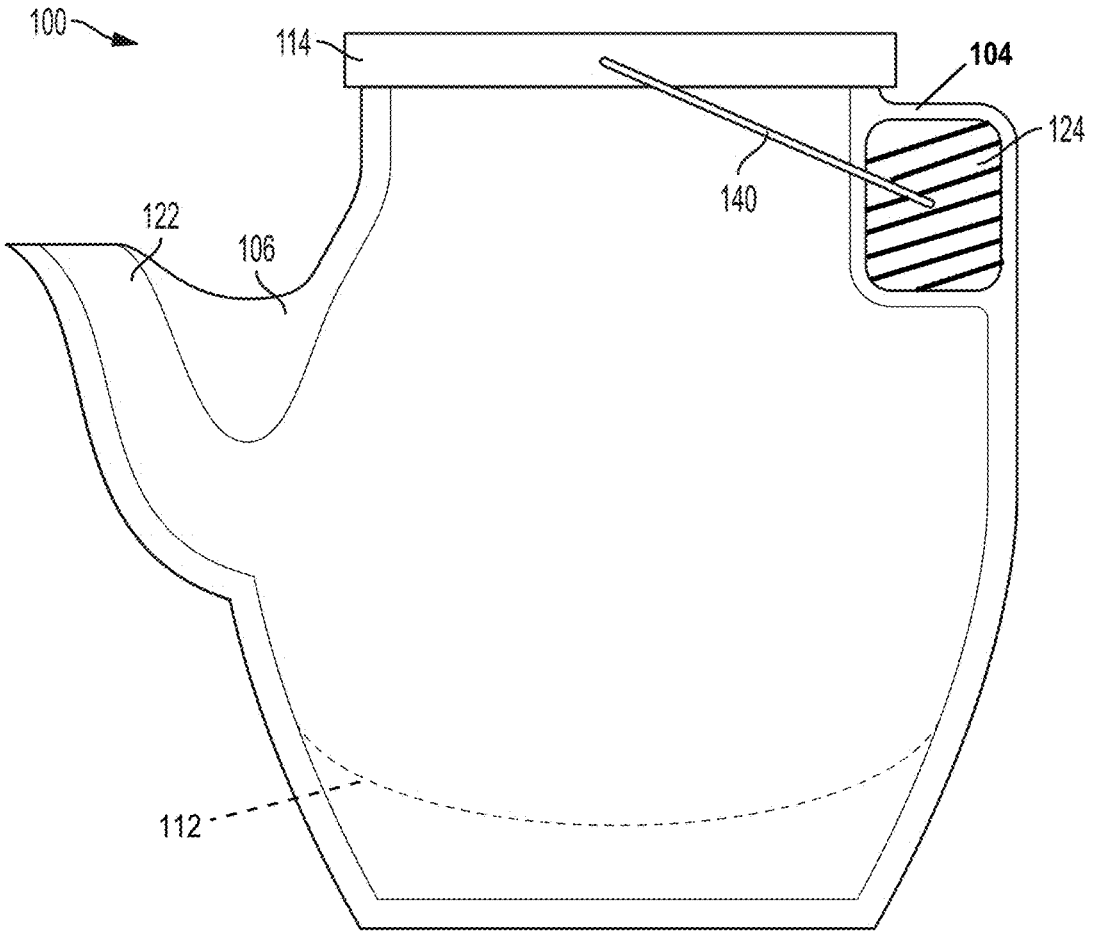
FIG. 4 is side view of an embodiment of the lota with stabilization features.
Figure 6:
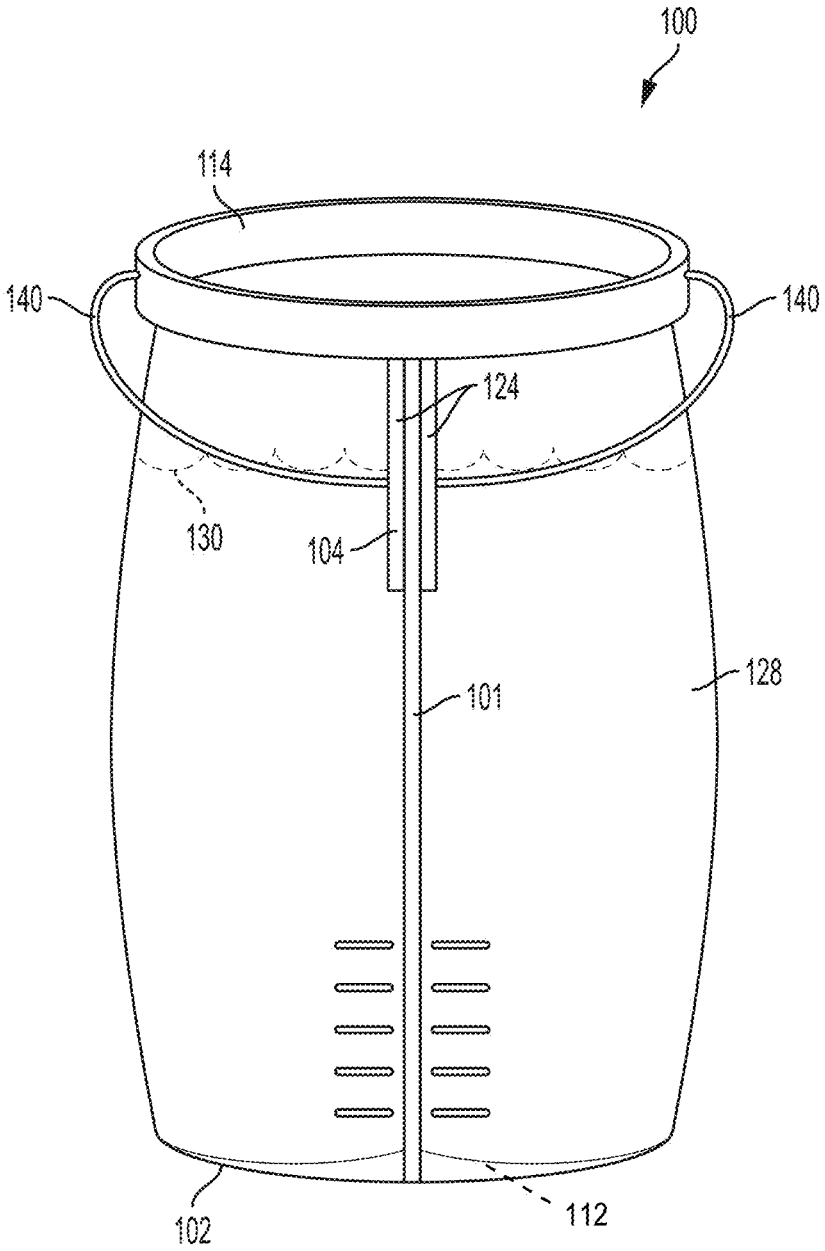
FIG. 6 is a rear view of the embodiment of FIG. 4 filled with liquid.
Figure 7:
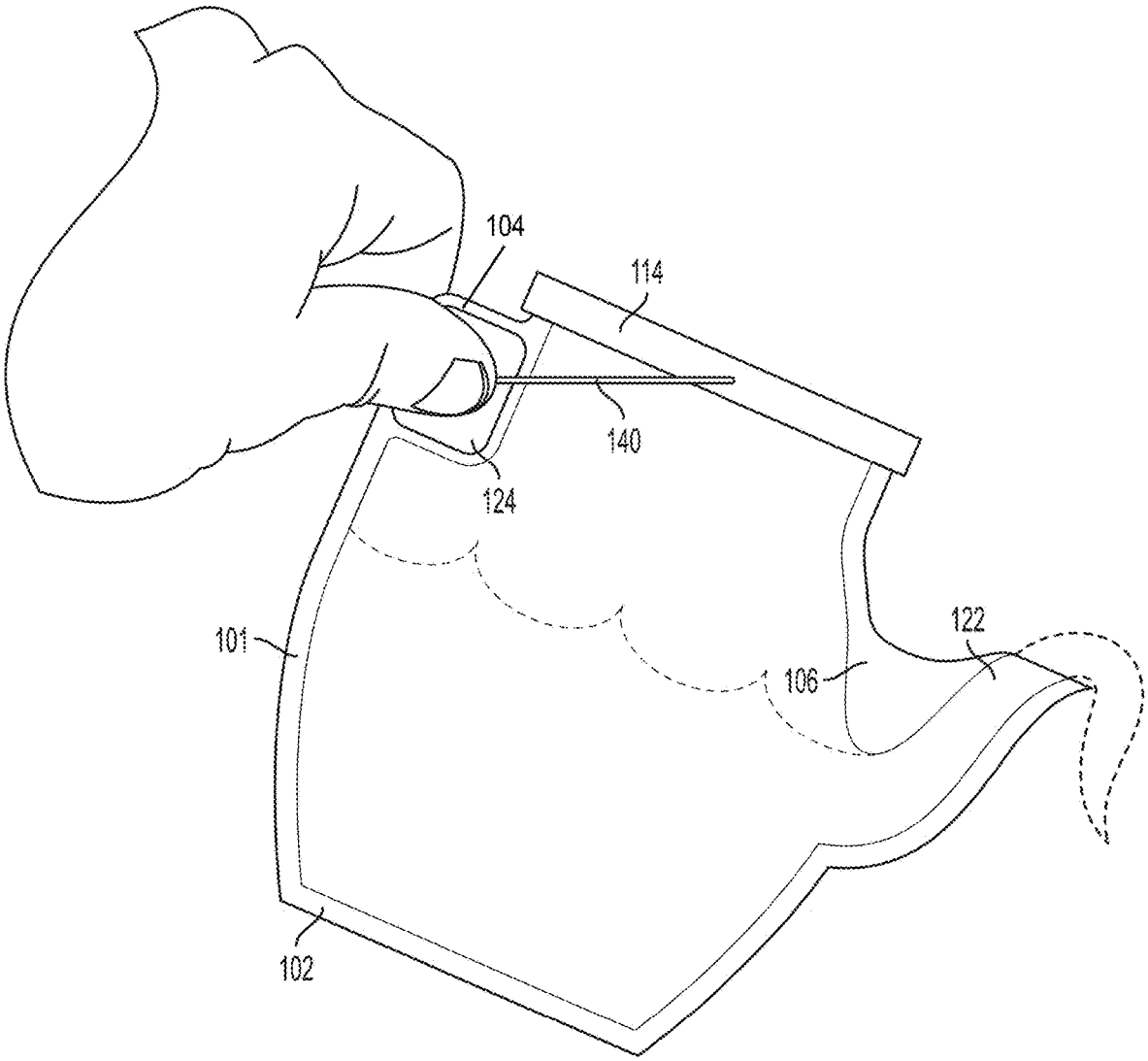
FIG. 7 is a side view of the embodiment of FIG. 4 in use.

As shown in the embodiments of FIGS. 1, 4 and 7, the inventive lota 100 is formed from sheets of a flexible, substantially waterproof membrane that are sealed or welded together at the edges 101 to define a bladder body that includes a bottom portion 102, a handle portion 104, and a spout divider 106. The top of the vessel between the handle portion 104 and the spout divider 106 remains open to provide an opening 110 for introducing water into the bladder. The sealing process by which the membrane layers are attached may involve use of a water-tight adhesive, heat or ultrasonic welding, or other assembly process as is known in the art for sealing plastics and synthetic materials. The sealing process will depend on the membrane material. Selection of an appropriate sealing process will be within the level of ordinary skill in the art. In the exemplary embodiment, the general shape defined by the sealing process approximates the cross-section of a traditional lota, similar to a tea pot, with a lower vessel portion 120, a spout portion 122, and fill opening 110. As will readily apparent to those in the art, alternative configurations of vessel can be formed, e.g., rounded, flattened, more angular, or various combinations thereof, to enhance aesthetics or ease of handling, provided that the basic components of a handle, spout and fill opening are provided. As shown in FIG. 2, an optional gusset section 112 is preferably formed in the bottom portion 102 to create a flat surface on which the vessel may stand on its own when the vessel is filled with water 130 and fully expanded. FIG. 6 illustrates a filled vessel with the gusset expanded.

The membrane from which the bladder body is formed may have a thickness on the order 0.1 mm to 0.4 mm (~0.005 to 0.012 inch) and is preferably a food-grade material such as polyethylene (UMHW-PE, LD-PE, HD-PE), acetal co-polymer, acrylic, poly-lactic acid (PLA), vinyl, or other known plastics and polymers. It should be sufficiently foldable and pliable to allow the unfilled bladder to be folded flat into the interior of the support ring 114. While the examples illustrated herein are constructed using a clear plastic material, it will be readily apparent that colored, translucent, or opaque plastic sheeting or other membrane materials may be used to form the vessel. In some embodiments, it may be desirable to employ a plant-based membrane material that is partially biodegradable to address concerns about increased plastics in landfills.

Figure 5:
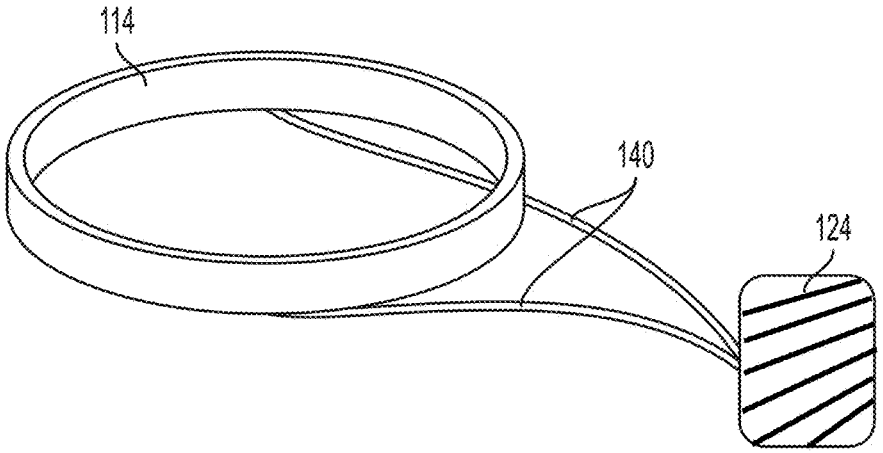
FIG. 5 is a perspective view of an exemplary support structure assembly.

Handle portion 104 may be reinforced by tabs 124 formed from one or more additional layers of membrane or a thin piece of heavier gauge plastic sheeting that is welded or otherwise affixed to the sheet material for added stability and strength. The handle tabs 124 may include a grip-enhancing feature, such as a ribbed (e.g., as shown in FIGS. 4 and 5), knurled, or pebbled surface to prevent slippage if the handle becomes wet during filling or use.

Figure 3:
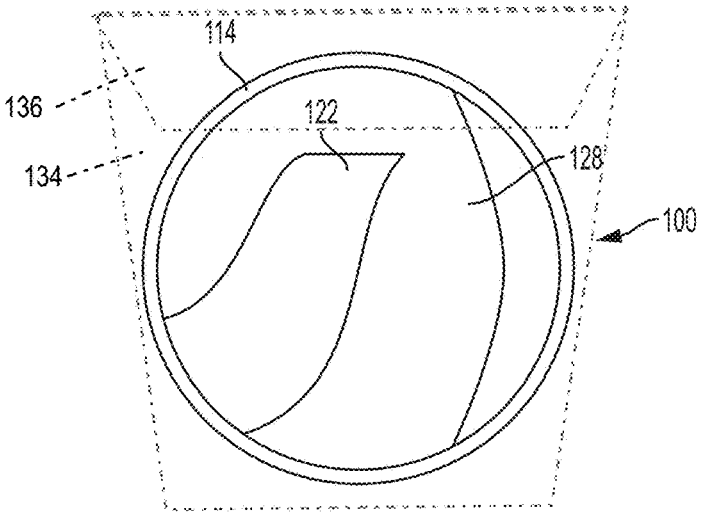
FIG. 3 is a diagrammatic top view of an embodiment of the lota folded into the support ring, prior to filling.

The edges of fill opening 110 are sealed, again via adhesive, welding, or other appropriate technique, to the sidewalls of a support ring 114 formed from a more rigid material than that used for the bladder body. The combination of the ring 114 and the opening 110 define the fill mouth through which the vessel is filled. The ring 114 may be formed from a plastic or cardboard strip (or similar material) that is resilient but holds its shape. In an exemplary embodiment, the plastic material of which the ring is made may be polypropylene with a thickness of about 2.5 mm (~0.100 in.) and about 12.5 mm (~0.5 in) wide, formed into an annular structure that is about 5-6 cm (~2.25 in.) in diameter. The entire bladder body 128 folds easily into the interior of the ring 114, as shown in FIG. 3. This structure may then be sealed in standard shrink wrap packaging, a small foil, plastic or polymer bag, or a foil or paper wrapping to create a convenient package that can be easily and discretely carried in the user's pocket, purse, backpack or other carrier for easy access when needed. For illustrative purposes, the inventive lota 100 is shown in FIG. 3 encased in a clear film envelope 134 with an openable flap 136, indicated by dashed lines.

For use, after opening the packaging, the user unfolds the bladder body 128 away from the ring 114, and holds the fill opening 110 and ring 114 under a faucet to fill the bladder. As shown in FIG. 6, as the lower vessel portion 120 begins to fill, the weight of the water causes gusset 112 to expand, creating a flat bottom that allows the filled vessel to stand unsupported on a shelf or flat surface as the user prepares for cleansing. When ready, the user holds the handle portion 104, as shown in FIG. 7, to tilt the lota to pour water out of spout 122 and onto the desired body part. After use, the lota can be discretely discarded in a trash container.

In the embodiment shown in FIG. 4, additional stabilization of the vessel can be provided by attaching struts 140 or stringers to the support ring 114 and to the handle tabs 124 of handle portion 104 on each side of the vessel. Alternatively, the struts 140 may be attached to some other reinforced area of the bladder body that is capable of providing adequate support. The struts 140 can be formed from separate polypropylene or Nylon filaments, or other suitable materials that are then affixed (via adhesive, welding, or other appropriate fastening means) to the ring and handle tabs (or other appropriate location on the bladder), or they may be formed integrally with the support ring and handle tab by molding of polypropylene or similar plastic or polymer, as shown in FIG. 5. The struts provide both strength and stability to the filled vessel during use without adding weight or restricting flexibility or compressibility of the packaged structure before use.

The inventive portable lota may be made from inexpensive materials that are capable of retaining water for use in personal ablution. The inventive lota is lightweight and pre-folded into a compact container that is nearly flat, allowing it to be discretely carried in a pocket, purse or backpack, and unfolded for use when needed. As will be readily apparent based on the present description and accompanying drawings, the portable vessel can be used for virtually any application in which temporary retention and dispensing of a relatively inert liquid is desired.

The foregoing description and accompanying drawings provide illustrative examples of lotas or vessels that incorporate the principles of the invention. These examples are not intended to be limiting, and it will be readily apparent to those in the art that different permutations and combinations of the features described herein may be made that still fall within the scope of the invention.

The invention claimed is:

1. A vessel comprising:

a bladder body formed from substantially waterproof membrane sheets sealed at least partially around the sheet edges to define a water-retaining volume having a bottom portion and a top portion having a top opening;

a spout integrally formed with the bladder body and comprising a tapered tubular extension from a side of the bladder body, the tubular extension having a proximal end in fluid communication with the water-retaining volume and a distal end separated from the water-retaining volume by a spout divider, the distal end having a dispensing opening disposed below the top portion;

a handle portion integrally formed with the bladder body and extending from an upper portion of the bladder body on a side opposite the spout, wherein the handle portion is disposed at a height above the proximal end of the spout; and a substantially rigid support ring fixedly adhered to an outer surface of the top opening to define an open fill mouth for introducing water into the bladder body;

wherein the bladder body, the spout and the handle portion are collapsible and foldable for storage within an interior of the support ring.

2. The vessel of claim 1, wherein the handle portion further comprises reinforcing handle tabs attached thereto.

3. The vessel of claim 1, further comprising stability struts extending between a reinforced portion of the bladder body and the support ring.

4. The vessel of claim 3, wherein the reinforced portion of the bladder body comprises handle tabs attached to the handle portion, and wherein the stability struts, handle tabs and support ring are molded together as an integrated structure.

5. The vessel of claim 1, wherein the handle portion comprises a ribbed, knurled, or pebbled surface.

6. The vessel of claim 1, wherein the membrane sheets comprise a food-grade plastic or polymer.

7. The vessel of claim 1, wherein the bottom portion comprises a gusset.

8. The vessel of claim 1, wherein the spout divider is defined by sealing the membrane sheets together between the water-retaining volume and the distal end of the spout.

9. A vessel comprising:

a substantially rigid ring; and a bladder body having an upper opening fixedly adhered to an inside surface of the ring to define an open fill mouth, the bladder body formed from substantially waterproof membrane sheets sealed at least partially around the sheet edges to define a bottom portion configured to retain water;

a spout integrally formed with the bladder body and comprising a tapered tubular extension from a side of the bladder body, the tubular extension having a proximal end in fluid communication with the water-retaining volume and a distal end separated from the water-retaining volume by a spout divider, the distal end having a dispensing opening disposed below the top portion;

a handle portion integrally formed with the bladder body and extending from an upper portion of the bladder body on a side opposite the spout, wherein the handle portion is disposed at a height above the proximal end of the spout; and wherein the ring is formed front a more rigid material than that of the bladder body and the bladder body is collapsible and foldable for storage within an interior of the ring.

10. The vessel of claim 9, wherein the handle portion further comprises reinforcing handle tabs attached thereto.

11. The vessel of claim 9, further comprising stability struts extending between a reinforced portion of the bladder body and the ring.

12. The vessel of claim 11, wherein the reinforced portion of the bladder body comprises handle tabs attached to the handle portion, and wherein the stability struts, handle tabs and the ring are molded together as an integrated structure.

13. The vessel of claim 9 wherein the handle portion comprises a ribbed, knurled, or pebbled surface.

14. The vessel of claim 9, wherein the membrane sheets comprise a food-grade plastic or polymer.

15. The vessel of claim 9, wherein the bottom portion comprises a gusset.

16. The vessel of claim 9, wherein the spout divider is defined by sealing the membrane sheets together between the water-retaining volume and the distal end of the spout.

17. A compact, portable vessel, comprising:

a bladder body formed from substantially waterproof membrane sheets sealed at least partially around the sheet edges to define a bottom portion while leaving a top opening, the bottom portion configured to retain a liquid, wherein the bottom portion comprises an expandable gusset configured to define a flat bottom when the bladder body is filled with liquid;

a spout integrally formed with the bladder body and comprising a tapered tubular extension from a side of the bladder body, the tubular extension having a proximal end in fluid communication with the water-retaining volume and a distal end separated from the water-retaining volume by a spout divider, the distal end having a dispensing opening disposed below the top portion, wherein the spout divider is defined by sealing the membrane sheets together between the water-retaining volume and the distal end of the spout;

a handle portion integrally formed with the bladder body and extending from an upper portion of the bladder body on a side opposite the spout, wherein the handle portion is disposed at a height above the proximal end of the spout; and a substantially rigid ring fixedly adhered to an outer surface of the top opening to define an open fill mouth for introducing liquid into the bladder body;

wherein the ring is formed from a more rigid material than that of the bladder body and the bladder body is sufficiently foldable and pliable for storage within an interior of the ring, wherein tilting the bladder body when at least partially filled with liquid causes the liquid to be dispensed through the dispensing opening, and wherein the ring, defines a compact package having a dimension on the order of 5-6 cm.

18. The vessel of claim 17, wherein the handle portion further comprises reinforcing handle tabs having a ribbed, knurled, or pebbled surface.

19. The vessel of claim 17, further comprising stability struts extending between a reinforced portion of the bladder body and the ring.

20. The vessel of claim 19, wherein the reinforced portion of the bladder body comprises handle tabs attached to the handle portion, and wherein the stability struts, handle tabs and the ring are molded together as an integrated structure.

* * * * *